United States Patent [19]

Sakamoto

[11] Patent Number: 4,882,605

[45] Date of Patent: Nov. 21, 1989

[54] ELECTROPHOTOGRAPHIC COPYING MACHINE

[75] Inventor: Masashi Sakamoto, Osaka, Japan

[73] Assignee: Minolta Camera Kabushiki Kaisha, Osaka, Japan

[21] Appl. No.: 249,336

[22] Filed: Sep. 26, 1988

[30] Foreign Application Priority Data

Sep. 25, 1987 [JP] Japan ..... 62-240337

[51] Int. Cl.[4] ..... G03G 15/06

[52] U.S. Cl. ..... 355/215; 355/245; 355/326; 355/328

[58] Field of Search ..... 355/245, 210, 215, 251–254, 355/259, 328, 326, 296, 297, 301, 302, 303; 118/645, 653–658

[56] References Cited

U.S. PATENT DOCUMENTS

| | | | |
|---|---|---|---|
| 3,814,515 | 6/1974 | Takahashi et al. | 355/3 DD |
| 4,168,901 | 9/1979 | Ito et al. | 355/215 |
| 4,400,081 | 8/1983 | Yamashita et al. | 355/15 |
| 4,674,865 | 6/1987 | Tada et al. | 355/215 |
| 4,705,394 | 11/1987 | Watanabe | 355/245 |
| 4,730,205 | 3/1988 | Ogiri et al. | 355/298 |
| 4,754,301 | 6/1988 | Kasamura et al. | 355/326 X |

*Primary Examiner*—R. L. Moses

*Attorney, Agent, or Firm*—Burns, Doane, Swecker & Mathis

[57] ABSTRACT

An electrophotographic copying machine which comprises a rotatable photoreceptor, a developing devices including a first removable developing device and a second developing device provided at downstream of the first removable developing device with respect the rotation of the photoreceptor, a first seal member arranged at the first developing device for preventing toner from scattering, a second seal member which is arranged at the second developing device for preventing toner from scattering and is movable to contact with the photoreceptor, a first moving member for moving the second seal member from a first state to be out of contact with the photoreceptor to a second state to be in contact therewith upon the removal of the first developing device, and a second moving member for moving the second seal member from the second state to the first state upon the attachment of the first developing device.

4 Claims, 4 Drawing Sheets

ELECTROPHOTOGRAPHIC COPYING MACHINE

BACKGROUND OF THE INVENTION

1. Field of the Invention

The present invention relates to an electrophotographic apparatus, for example, an electrophotographic copying machine, a printer employing an electrophotographic method or the like wherein at least one of the developing devices disposed along a photoreceptor is removable.

2. Description of the Prior Art

In the case where color-development is carried out by use of an electrophotographic apparatus comprising a plurality of developing devices along the surface of a photoreceptor, a developing device located at upstream of the remainings with respect to the direction of the rotation of the photoreceptor is usually used as a color-developing device, for example, red-color-developing device for the purpose of preventing toner color mixing. Accordingly, the developing device located at upstream of the other with respect to the direction of the rotation of the photoreceptor is conventionally removable in order to facilitate the exchange of toner color.

Meanwhile, in a developing device, there arises the problem that toner unused for the development scatters around the location between the photoreceptor and a casing of the developing device. A scattering toner forms powder smoke to rise up or falls down to a non-image portion on the surface of the photoreceptor. Particularly, in the above-mentioned electrophotographic apparatus comprising a plurality of developing devices, the scattering toner mixes into other developing devices or brings a fog in the non-image portion on the surface of the photoreceptor.

Therefore, a seal member for preventing toner scattering is usually arranged at a developing device in order to prevent toner from scattering by its contact with the photoreceptor. But in such electrophotographic apparatus, the seal member for the developing device located at downstream with respect to the direction of the rotation of the photoreceptor requires to be in contact with or out of contact with the photoreceptor in accordance with the attachment and the removal of the developing device located at upstream of the other with respect to the direction of the rotation of the photoreceptor. In other words, said upstream developing device must be attached following the retreat of the seal member arranged at the downstream developing device from the photoreceptor so as to prevent the seal member arranged at the downstream developing device from destroying a toner image developed by the upstream developing device. On the contrary, in the case of removal of the developing device located at upstream, the seal member arranged at the developing device located downstream must be brought into contact with the photoreceptor for preventing toner scattering.

Although the Japanese Patent Laid-open Application No. 62-211675 discloses an electrostatic latent image developing device wherein the seal member for the developing device located at downstream is caused to be in contact with or out of contact with the photoreceptor by use of a solenoid. However, the use of the electric member not only complicates the construction of said developing device but also disadvantages in term of cost.

SUMMARY OF THE INVENTION

The main object of the present invention is to provide an electrographic apparatus which comprises a plurality of developing devices and in which a toner image developed by a developing device located at upstream of the other with respect to the direction of the rotation of a photoreceptor is not destroyed and the fog is not formed in a non-image portion on the surface of the photreceptor by providing a seal member at a developing device located at downstream with respect to the direction of the rotation of the photoreceptor to be movable in contact with or out of contact with the photoreceptor.

Another object of the present invention is to provide an electrophotographic apparatus with a plurality of developing devices which are simple in construction and which are free of electrical moving means to move the seal member arranged at the developing device located at downstream for the purpose of inexpensively manufacturing in its cost.

These and other objects can be achieved by providing an electrophotographic apparatus, which comprises a rotatable photoreceptor, a first removable developing device located at upstream of the remainings with respect to the direction of the rotation of the photoreceptor, a second developing device located at downstream with respect thereto, a first seal member arranged at said first developing device for preventing toner from scattering, a second seal member arranged at said second developing device for preventing toner from scattering, a first moving means for moving said second seal member from a first condition to be out of contact with the photoreceptor to a second condition to be in contact therewith upon the removal of the first developing device, and a second moving means for moving said second seal member from the second condition to the first condition upon the attachment of the first developing device These and other objects, advantages and features of the invention will become apparent from the following description thereof taken in conjunction with the accompanying drawings which illustrate specific embodiments of the invention.

BRIEF DESCRIPTION OF THE DRAWINGS

In the following description, like parts are designated by like reference numbers throughout the several drawings.

FIG. 2 is a perspective view of an attaching and removing means for attaching a first developing device to the electrophotographic copying machine proper and removing that therefrom.

FIG. 3 is a perspective view of a part of a mechanical moving means for retreating a seal member for a second developing device.

FIG. 4 is a cross-sectional view schematically showing the condition in which the first developing device is inserted to the copying machine proper.

FIG. 5 is a cross-sectional view schematically showing the condition in which the first developing device is brought close to the correct attachment position of the first developing device.

FIG. 6 is a cross-sectional view schematically showing the condition in which the first developing device is completely attached at the correct attachment position.

FIG. 7 a schematic cross-sectional view showing the condition in which the first developing device is inserted to the copying machine proper.

FIG. 8 is a schematic cross-sectional view showing the condition in which the first developing device is completely attached at the correct attachment position.

DESCRIPTION OF THE PREFERRED EMBODIMENTS

In the following, the preferred first embodiment of an electrophotography copying machine in accordance with the present invention will be described with reference to the drawings.

Figure 1:
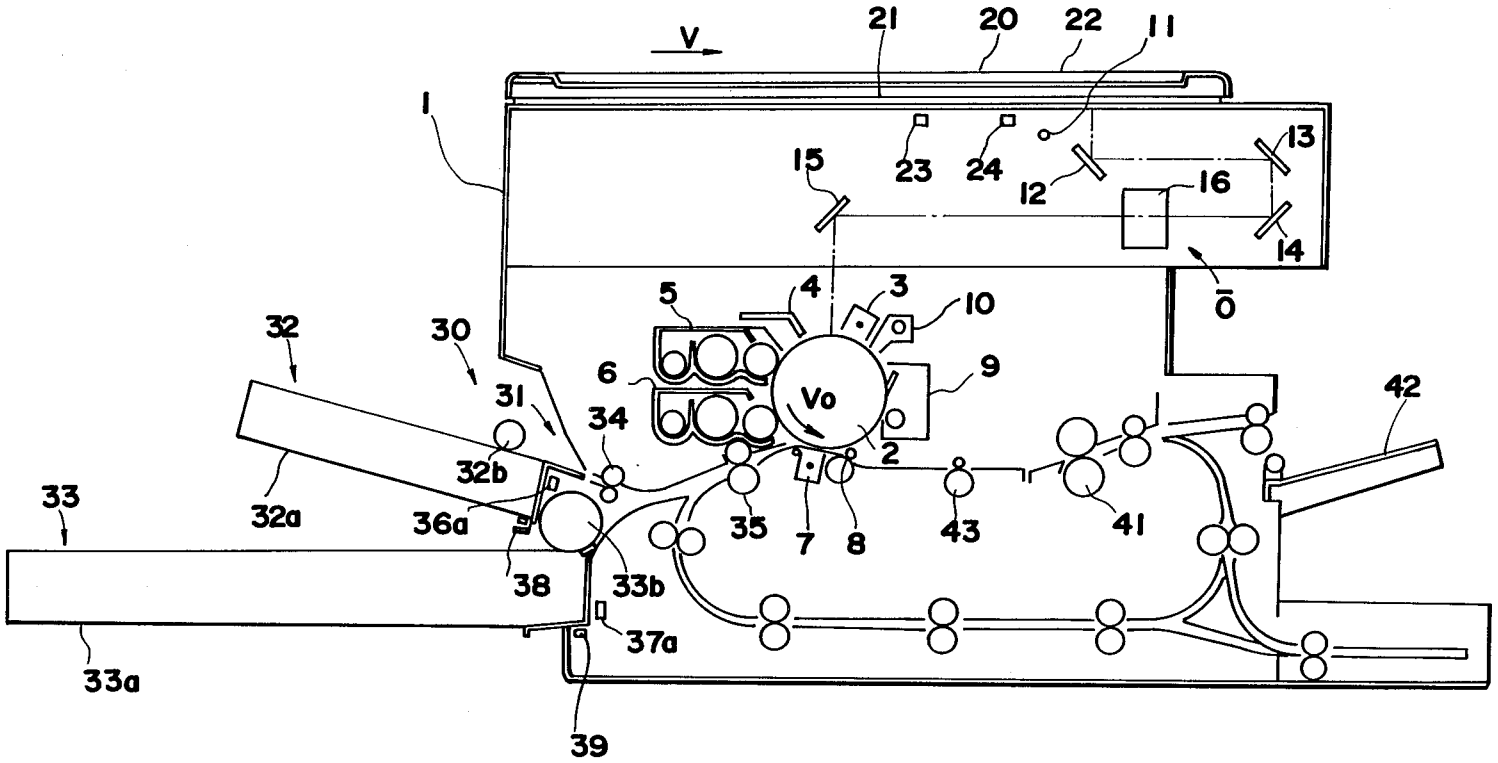
FIG. 1 is a schematic cross-sectional view of an electrophotographic copying machine comprising the developing devices of the present invention.

FIG. 1 is a schematic cross-sectional view of an electrophotographic copying machine comprising the developing devices of the present invention. The schematic construction of said electrophotographic copying machine as well as the operation of the electrophotographic copying machine will be explained hereinafter.

At first, on condition that a photoreceptor drum 2 is rotating in a direction as shown by an arrow $V_0$, a transfer charger 7 and an exposure lamp 11 of an optical system 0 are switched on. Simultaneously, the surface of the photoreceptor drum 2 is charged by a corona charger 3. Eraser 4 is arranged for the removal of the charges in the area between a front end of an original (not shown) placed on an original document glass 21 in a scanning direction and a rear end of that in the same direction.

When the photoreceptor drum 2 and elements thereabout are set as mentioned above, the reflective light, which is brought on an original surface by the exposure lamp 11, exposes the surface of the photoreceptor drum 2 through reflective mirrors 12, 13, 14, 15 and a lens 16 in order to form an electrostatic latent image corresponding to an original image while a document glass table 20 is moved in a direction as shown by an arrow (right direction) in FIG. 1.

The electrostatic latent image formed on the surface of the photoreceptor drum is transported to pass through a portion confronting a first developing device 5 and a second developing device 6 by the rotation of the photoreceptor drum 2. In this process, the electrostatic latent image is developed by toner of either or both of the first developing device 5 and the second developing device 6 so as to form a toner image.

It is to be noted here that the second developing device 6 provides black toner in a black copy mode and the first developing device 5 provides color toner in a color copy mode. Further, if the mode is set to a one shot two color copy mode (hereinafter referred to "1s 2c copy mode") wherein a dual-color copy is carried out by the first developing the image by the first developing device 5 and followed by the second developing device 6 during single scanning operation, the first developing device 5 provides color toner on the electrostatic latent image from the front end of the original to be scanned to a predetermined area manually resignated. At the same time, the developing device 6 provides black toner on the electrostatic latent image from the remaining portion to the rear end of that original.

A copying paper is fed from a paper feeding system 30 to the front of a timing roller 35.

Subsequently, the copying paper is transported to a portion where the photoreceptor drum 2 confronts to the transfer charger 7 in timed relation with the image on the photoreceptor drum 2 so as to transfer the above-mentioned toner image thereon.

The copying paper having the transferred image thereon is separated from the surface of the photoreceptor drum 2 by a separating belt 8 and is transported to a fixing device 41 through a transporting roller 43. Next, this copying paper is discharged into a discharging portion 42 following the heat-fixation of the above-mentioned toner image on the copying paper by the fixing device 41.

Meanwhile, the residual toner on the surface of the photoreceptor drum 2 is removed by a cleaning device 9 to be collected within the cleaning device 9. The residual electric charges on the surface of the photoreceptor drum 2 is also removed by means of a main eraser 10 which is always illuminated while a main motor is driving.

In the first embodiment shown in FIG. 2 to FIG. 6, a first developing device 5 and a second device 6 are disposed along the periphery of the photoreceptor drum 2. It is to be noted here that the first developing device 5 is disposed at upsteam with respect to the direction as shown by an arrow $V_0$ of the rotation of the photoreceptor, and the second developing device 6 is disposed at downstream with respect to the direction as shown by the arrow $V_0$ of the rotation of the photoreceptor.

The first developing device 5 for the color-development is a removable developing device which includes within a casing 110 a developing roller 112 and a supplying roller 113 for supplying said developing roller 112 with the developer.

The second developing device 6 for the development with black toner is a developing device which includes a developing roller 220, a toner supplying roller 230 and the like within a casing 210.

The first developing device 5 is provided with a first filmy seal member 100 made of synthetic resin at the upstream side of the developing roller 112 with respect to the direction of the rotation (counterclockwise direction) of the developing roller 112 to thereby prevent toner scattering.

Figure 2:
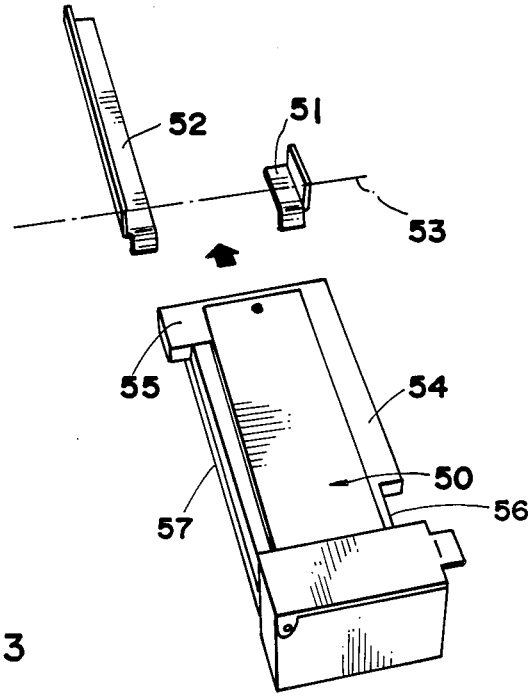
FIG. 2 to FIG. 6 show a first embodiment according to the present invention.
Figure 4:
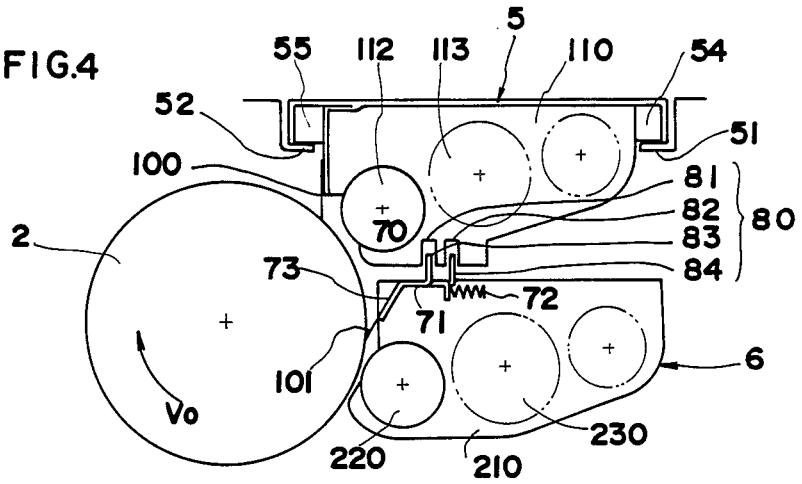
Figure 5:
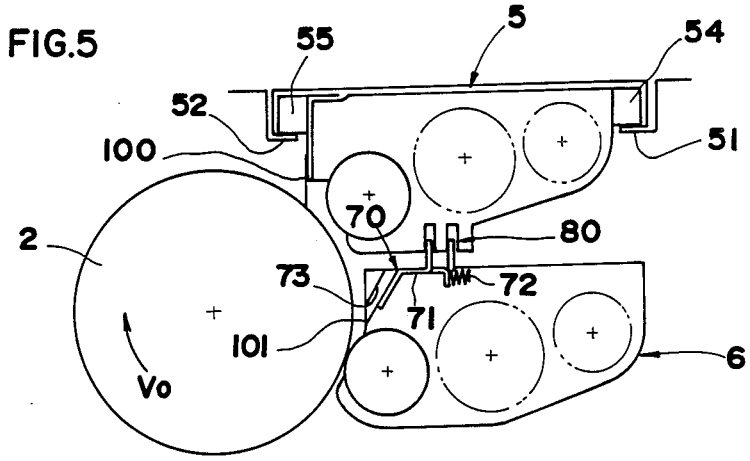
Figure 6:
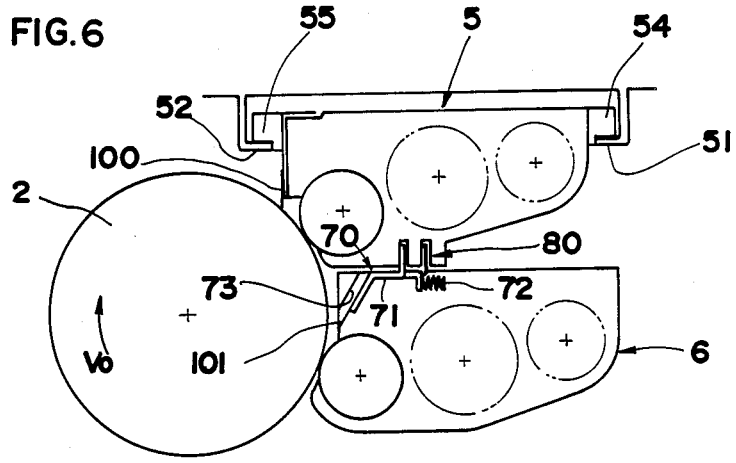

In addition, arranged at the first developing device 5 is a structure 50 for receiving the first developing device 5 to the correct attachment position in the copying machine proper 53. The one side of the structure 50 has a long convex portion 54 at the upstream side of the structure with respect to the direction of insertion of the first developing device 5 and another side of the structure has a short convex portion 55 at the downstream side of the structure with respect to the direction of the insertion of the first developing device 5 as shown in FIG. 2. It is to be noted here that the copying machine proper is provided with guide members 51 and 52 above the correct attachment position of the first developing device 5 for guiding said convex portions 54 and 55 of the structure 50 closed to the correct attachment position. The guide member 51 has the same length as that of the short concave portion 54 as shown in FIG. 2. Similarly, the guide member 52 has the same length as that of the long concave portion 57. When the first developing device 5 is inserted to the copying machine proper as shown in FIG. 2, the convex portions 54 and 55 are respectively guided on the guide members 51 and 52 so that the first developing device 5 is brought to the correct attachment position of the first developing device as shown in FIG. 4 and 5. Subsequently, when the first developing device 5 is guided above the correct attachment position by the guide members 51 and 52, the first developing device falls to the correct attachment position as shown in FIG. 6 because the guide members 51 and 52 support the first developing device 5 only to the extent close to the correct attachment position owing to their lengthes. As a result, the first seal member 100 is brought into contact with the photoreceptor 2.

The second developing device 6 is provided with a second seal member 101 similar to the first seal member 100 at the upstream side of the developing roller 220 with respect to the direction of the rotation (counterclockwise direction) of the developing roller 220 to thereby prevent toner scattering. This seal member 101 is supported by a first mechanical moving means 70 arranged at the second developing device 6 for bringing the second seal member 101 into contact with the photoreceptor. The first mechanical moving means 70 is composed of a member 71 (hereinafter referred to a supporting member 71) for supporting the second seal member which slides along the casing 210 of the second developing device and a spring 72 which always urges the supporting member 71 towards the photoreceptor. Consequently, the supporting member 71 is urged against a stopper 73 on the second developing device 6 by the force of the spring 72, so that the second seal member 101 is brought into contact with the photoreceptor 2.

Figure 3:
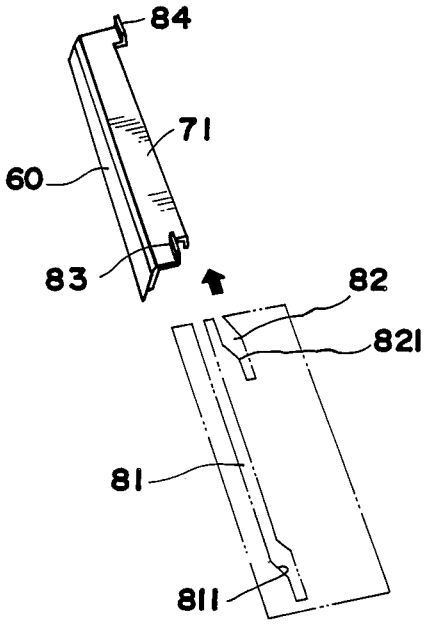

A second mechanical moving means 80 for retreating the second seal member 101 from the photoreceptor 2 is arranged in the copying machine. Said second mechanical moving means 80 consists of grooves 81 and 82 provided at the bottom of the first developing device 5 as well as projections 83 and 84 placed on the supporting member 71 for insertion on said grooves as shown in FIG. 3. The groove 81 has a sufficient length and extends in a direction of the removal of the second mechanical moving means 80. The another groove 82 has a shorter length than the groove 81 and extends the same direction. Both of grooves 81 and 82 respectively have curved slit portions 811 and 821 curving in a direction of the retreat of the second seal member as shown in FIG. 3. Therefore, when the first developing device 5 is inserted to the copying machine proper as shonw in FIG. 4 and is brought to the correct attachment position as shown in FIG. 5, the projections 83 and 84 on the supporting member 71 are pushed against the spring respectively by the curved slit portion 811 of the groove 81 and the courved slit portion 821 of the groove 82, resulting in that the second seal member 101 is caused to retreat from the photoreceptor 2. When the first developing device 5 is further inserted to the copying machine proper, said first developing device 5 falls onto the correct attachment position so that the second seal member 101 is maintained in the condition to be out of contact with the photoreceptor 2. It is to be noted here that the first seal member 100 arrranged at the first developing device 5 is in contact with the photoreceptor 2 instead of the second seal member 101 for the purpose of preventing toner scattering during the development.

Figure 7:
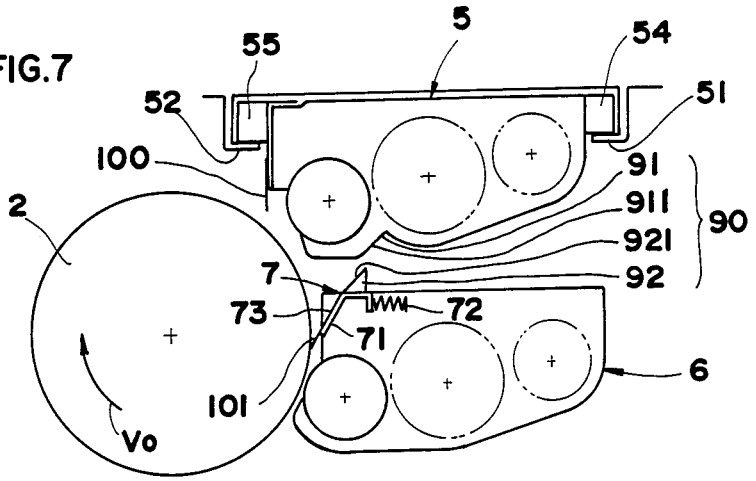
FIG. 7 and FIG. 8 show a second embodiment according to the present invention.
Figure 8:
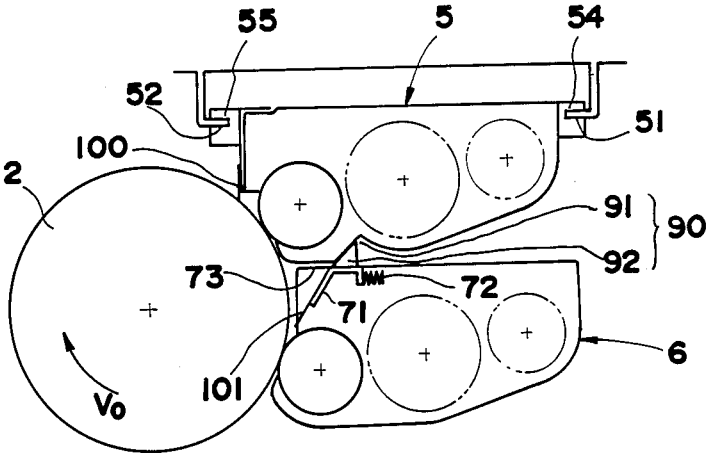

The second embodiment will be explained hereinafter with reference to FIG. 7 and FIG. 8.

The copying machine of the second embodiment is generally similar in construction to that of the first embodiment except for the second mechanical moving means for retreating the second seal member 101 from the photoreceptor 2.

In this embodiment, the copying machine has the first mechanical moving means 70 for bringing the second seal member 101 into contact with the photoreceptor 2 and a second mechanical moving means 90 for retreating the second seal member 101 from the photoreceptor 2. The second mechanical moving means 90 consists of a concave portion 91 provided at the bottom of the first developing device 5 and having a slope 911 as well as a projection 92 provided on the supporting member 71 for supporting the second seal member 101. Said projection 92 has a slope 921 which is formed so as to fit said slope 911 of said concave portion 91. Although the concave portion 91 is out of contact with the projection 92 as shown in FIG. 7 before the first developing device 5 falls onto the correct attachment position, the slope 911 of the concave portion 91 matches with the slope 921 of the projection 92 following a fall of the frist developing device to the correct attachment position as shown in FIG. 8. Subsequently, the slope 911 of the concave portion 91 urges the slope 921 of the projection 92 against the spring 72 in a direction of retreat of the projection 92 from the photoreceptor on purpose to releave the contact between the second seal member 101 and the photoreceptor 2.

The characteristic of the developing devices in both of the first and second embodiments according to the present invention will be described hereinafter.

The first developing device is drawn out while being lifted in order to be removed from the copying machine proper. In accordance with the removal of the first developing device, the second seal member 101 for the second developing device 6 is brought into contact with the photoreceptor 2 by the spring 72 again.

Therefore, the second seal member 101 prevents toner from scattering even if the second developing device 6 is used in a condition that the first developing device 5 is removed.

Further, the second seal member 101 may be arranged at a frame (not shown) provided between the first developing device 5 and the second developing device 6 although the second seal member 101 is arranged at the second developing device 6 in the first and second embodiments. In the case where the second seal member is arranged at said frame, the first mechanical moving means 71 for bringing the second seal member into contact with the photoreceptor 2 as well as the spring 72 are required to be supported by the frame.

Moreover, the first developing device can be attached and removed not only in the direction as shown in the embodiments but also in a direction perpendicular thereto (for example, in right and left directions in FIG. 4) on condition that the second seal member is retreated from the photoreceptor upon the attachment of the first developing device.

As is clearly understood from the foregoing description, the present invention includes the second seal member 101 which does not require any removal before the attachment of the first developing device 5.

The second seal member 101 is automatically retreated from the photoreceptor 2 by the action of the second mechanical moving means 80 or 90 for retreating the second seal member 101 from the photoreceptor 2 when the first developing device 5 is attached. As a result, the toner image is formed on the photoreceptor 2 by the first developing device without being destroyed by the second seal member 101. Simultaneously, toner from scattering is preventted by the first seal member 100 arranged at the first developing device 5.

Furthermore, an operator can attach and remove the first developing device 5 simply and safely.

In addition, the present invention simplifies each construction of the first and second developing devices because of the use of a mechanical member as a means to move the second seal member arranged at the second developing device 6. Consequently, the developing devices of the present invention can be inexpensively manufactured.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. An electrophotographic copying machine which comprises:

rotatable photoreceptor;

developing means including a first removable unit and a second unit provided at downstream of said first removable unit with respect to the rotation of said photoreceptor;

first seal member arranged at said first unit for preventing toner from scattering;

second seal member which is arranged at said second unit for preventing toner from scattering and is movable to contact with said photoreceptor;

first moving means for moving said second seal member from a first state to be out of contact with the photoreceptor to a second state to be in contact therewith upon the removal of said first unit; and second moving means for moving the second seal member from said second state to said first state upon the attachment of the first unit.

2. An electrophotographic copying machine which is comprises:

rotatable photoreceptor;

developing means including a first removable unit which contains first color toner and is removable in the same direction as an axial direction and a second unit containing another color toner and provided at downstream of said first removable unit with respect to the rotation of the photoreceptor;

first seal member which is arranged at said first unit for preventing toner from scattering and is movable to contact with the photoreceptor;

second seal member arranged at said second unit for preventing toner from scattering;

first moving means for moving said second seal member from a first status to be out of contact with the photoreceptor to a second status to be in contact therewith interlocking relation with the removal of the first unit; and second moving means for moving said second seal member from the second status to the first status interlocking relation with the attachment of the first unit.

3. An electrophotographic copying machine as claimed in claim 2 wherein said first moving means includes a spring and a supporting member sliding along a casing of said second unit for supporting said second seal member.

4. An electrophotographic copying machine as claimed in claim 2 wherein said second moving means includes at least one or more grooves provided at the bottom of said first unit and projections placed on said supporting member for inserting on said grooves.

* * * * *